US010882208B2

(12) United States Patent
Fiore

(10) Patent No.: US 10,882,208 B2
(45) Date of Patent: Jan. 5, 2021

(54) PORTABLE LUMBER ADJUSTER

(71) Applicant: Shane Fiore, Bath, NH (US)

(72) Inventor: Shane Fiore, Bath, NH (US)

( * ) Notice: Subject to any disclaimer, the term of this patent is extended or adjusted under 35 U.S.C. 154(b) by 146 days.

(21) Appl. No.: 16/188,495

(22) Filed: Nov. 13, 2018

(65) Prior Publication Data

US 2020/0147829 A1 May 14, 2020

(51) Int. Cl.

| | |
|---|---|
| ***B27H 1/00*** | (2006.01) |
| *E04B 2/70* | (2006.01) |
| *B27M 1/08* | (2006.01) |

(52) U.S. Cl.

CPC ..... *B27H 1/00* (2013.01); *B27M 1/08* (2013.01); *E04B 2/70* (2013.01)

(58) Field of Classification Search

CPC .... B27H 1/00; B30B 7/04; B30B 9/32; Y10S 100/901; Y10S 100/913; E04B 2/70; B27M 1/00; B27M 1/02; B27M 3/00; B21D 3/10; B21D 3/14

USPC ..... 100/901

See application file for complete search history.

(56) References Cited

U.S. PATENT DOCUMENTS

| | | | | |
|---|---|---|---|---|
| 1,257,559 A * | 2/1918 | Webb | B30B 9/32 | 100/42 |
| 3,680,339 A * | 8/1972 | Hayakawa | B21D 5/01 | 72/28.1 |
| 4,104,962 A * | 8/1978 | Castillo | B30B 1/08 | 100/100 |
| 5,117,670 A | 6/1992 | Sartorio | | |
| 5,323,697 A * | 6/1994 | Schrock | B21D 39/048 | 100/232 |
| 10,010,982 B2 * | 7/2018 | Dexter | B21D 3/16 | |

FOREIGN PATENT DOCUMENTS

CN 206644099 A 11/2017

* cited by examiner

*Primary Examiner* — Matthew Katcoff
(74) *Attorney, Agent, or Firm* — Patent Negotiator, PLLC; Sarita L. Pickett, Esq.

(57) ABSTRACT

The present invention is a novel method and device for addressing the problem of a flexed or bowed log while building a log cabin. The device is a portable lumber straightening device capable of fitting over an 8" wide log and pushing the log straight so that the bent log lines up with an adjacent straight log. The portable device has a main bridge connecting two pushing walls on opposite sides of a channel. Pneumatic pistons on either side of the walls facilitate these walls in pushing inward to the degree required in respect to the main channel defined by the main bridge.

10 Claims, 9 Drawing Sheets

PORTABLE LUMBER ADJUSTER

BACKGROUND OF THE INVENTION

1. Field of the Invention

The present invention relates generally to a device for building a log cabin. Particularly, the present invention relates to a method for straightening lumber used in log cabins. More particularly, the present invention relates to a device for straightening logs used in building a log cabin.

2. Description of the Prior Art

Wooden homes and log cabins provide unique character, genuine craftsmanship, and rustic charm. There are many guides that are publicly available touting the ease of building a log cabin, emphasizing the lack of necessity for significant amounts of previous experience, skill or talent, but, instead emphasizing the need for hard work, planning, good tools, and natural resources. Such guides will emphasize the necessity for straight lumber and logs but provide little detail regarding methods for achieving this natural resource.

There are devices described in the prior art regarding wood straightening machines used in factories. For the following discussion of the prior art, figures and reference numbers are as provided in these respective references.

Chinese Patent Document Number 206644099U (Yanchang, 2017) discloses in Abstract, a "large cross-section wood straightening machine" as illustrated in FIG. 1 (reproduced for reference in this document as FIG. 1) having a straightening machine 1 with a mold comprising an upper mold 2 and lower mold 3. The upper mold 2 has a plurality of single upper molds 2' and a plurality of cylinders depression monomers 4'. The lower press 3 and upper mold 2 have a plurality of locking devices 6 which interact to reduce the load on the hydraulic cylinder 7 for processing larger sections of timber.

U. S. Pat. No. 5,117,670 (Sartorio, 1992) discloses a press brake system as shown in FIG. 1 (reproduced for reference in this document as FIG. 2) as having a device 10 for supplying the sheets W to a press brake 12. The press brake 12 an upper die 14 (a punch) and an interacting lower die 16 (a matrix). The punch 14 is fixed whilst the matrix 16 is movable towards the other and in the opposite direction along a working plane indicated B. The handling device 10 includes a support and guide beam 18 which extends parallel to the working plane B and is fixed to the floor.

A carriage 20 is mounted for sliding on the beam 18 and is movable along the beam in the direction of the X axis. The carriage 20 carries a pair of transverse guides 22 which extend parallel to the Y axis, are movable in the direction of the Z axis and on which a cross member 24 is slidably mounted. Two arms 26, mounted for sliding on the cross member 24, are movable in the direction of the X axis and carry respective gripper heads 28, also of known type, for gripping tightly the shorter edges 6 of worksheet W to be handled. The worksheet W is presented to the press 12 in a loading plane C perpendicular to the working plane B with the concave longitudinal edge of the sheet W facing the press brake 12.

SUMMARY OF THE INVENTION

As described above, the prior art has devices which can straighten a flexed or bowed log. The above-described parts of the prior art have not proven fully satisfactory for several reasons. Most notably, the methods and devices for repairing such defects presently known in the industry are costly and require the materials to be returned to the manufacturer for reshaping. The present invention provides a novel method of repairing a bowed log while in the midst of building a log cabin without having to tear apart the walls while building. Thus saving costs on materials and time which would otherwise be spent in shipping and returning the logs to and from other facilities. The portable device has a main bridge connecting two sides on opposite sides of a channel which would over fit a log wall. Pneumatic pistons on either side of the walls are capable of forcing these walls inward to the degree required in respect to the main channel defined by the main bridge. Pressure regulators are provided, as well as on/off valves, and flow control valves for regulating and controlling the air flow and pressure.

The present invention is a novel method of addressing a flexed or bowed log by providing a portable aligning device capable of fitting over an 8" wide log (as used to build log homes) and pushing it straight when the log is bowed so that the log lines up with the log below it.

It is an object of the present invention to provide a portable lumber adjuster having a framework capable of being manually lifted by a framework handle. The framework having horizontal panels and vertical walls forming a bridge having a channel. A pressure system having at least an initiation switch, a pressure regulator, and a manually adjustable valve. A piston system fluidly connected to the pressure system and securely supported by the framework, the piston system having a piston rod connected to a push pad. The push pad is capable of vertical alignment with a vertical wall of the framework.

It is another object of the present invention to provide a portable lumber adjuster with a bridge having a first horizontal panel and three vertical walls, the three vertical walls forming supporting ribs of steel at least 2 mm thick. A framework having right and left handles extending from the bridge for carrying and mounting the portable lumber adjuster into place for operation. A base of a vertical wall of the framework is integrally and perpendicularly connected with a horizontal piston supporting wall. The first horizontal piston supporting wall is integrally and perpendicularly connected with a vertical piston supporting wall. The vertical piston supporting wall is integrally connected with a rod holder; and the rod holder slidingly engages the piston rod.

The pressure system may be a pneumatic pressure system, and the piston system may be pneumatic piston system. The pneumatic pressure system may have tubing connecting the initiation switch, the pressure regulator, and the manually adjustable valve to a pneumatic piston of the pneumatic piston system. The initiation switch may be a manual air flow initiation switch; the pressure regulator may be an automatic emergency cut off pressure regulator; and the manually adjustable valve may be a manually adjustable cylinder spool bi-directional flow valve. The manually adjustable cylinder spool bi-directional flow valve may be capable of directing air flow in either a first air flow path towards an airport rear end cap and away from an airport rod end cap, and/or a second air flow path away from the airport rear end cap and towards the airport rod end cap. The first air flow path may cause the pneumatic pistons to move in a first direction, and the second air flow path may cause the pneumatic pistons to move in a second direction opposite to the first direction.

It is a further object of the present invention to provide a method of adjusting wooden beams while building a log cabin. The method including recognizing that a first log is horizontally misaligned with respect to a second log of the log cabin. The second log is vertically adjacent the first log. An axis of the first log should be consistently horizontally aligned or parallel with an axis of the second log—however, due to bending or curving, at least one portion of the first log is not horizontally aligned or parallel with an axis of the second log. The next step then, after identifying an error as above, is to employ a lumber adjuster according to the present invention.

A portable lumber adjuster may be installed for this purpose by manually lifting a portable lumber adjuster by a handle. The open u-shaped channels are designed so that it is easy to position the adjuster such that an axis of the first log is coaxial with a first channel of the adjuster, and an axis of the second log is coaxial with a second channel of the adjuster. The next step includes determining a direction of misalignment of the first log with respect to the second log, most of the time this is done manually by a user. The next step is setting a direction for a push pad of the adjuster; and then initiating a pressure system of the adjuster which is capable of moving the push pad of the adjuster.

The pressure system moves the push pad, and the push pad alters the first channel of the adjuster with respect to the second channel of the adjuster. This alters the position of the first log with respect to the second log, thereby horizontally adjusting the axis of the first log so as to be vertically aligned with the axis of the second log.

DETAILED DESCRIPTION OF THE INVENTION

Figure 1:
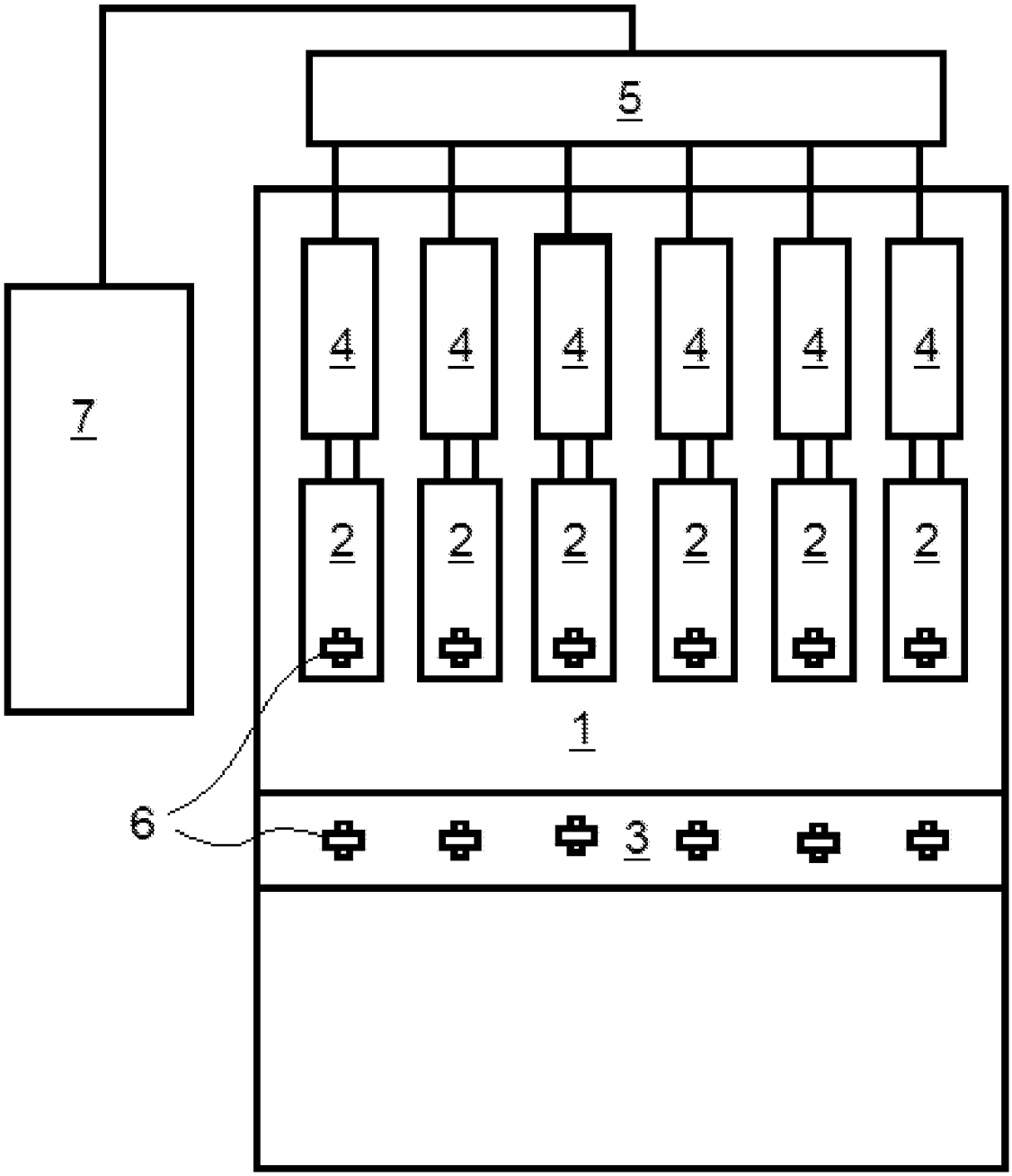
FIG. 1 (prior art)
FIG. 1 is a prior art illustration of a wood straightening system.
Figure 2:
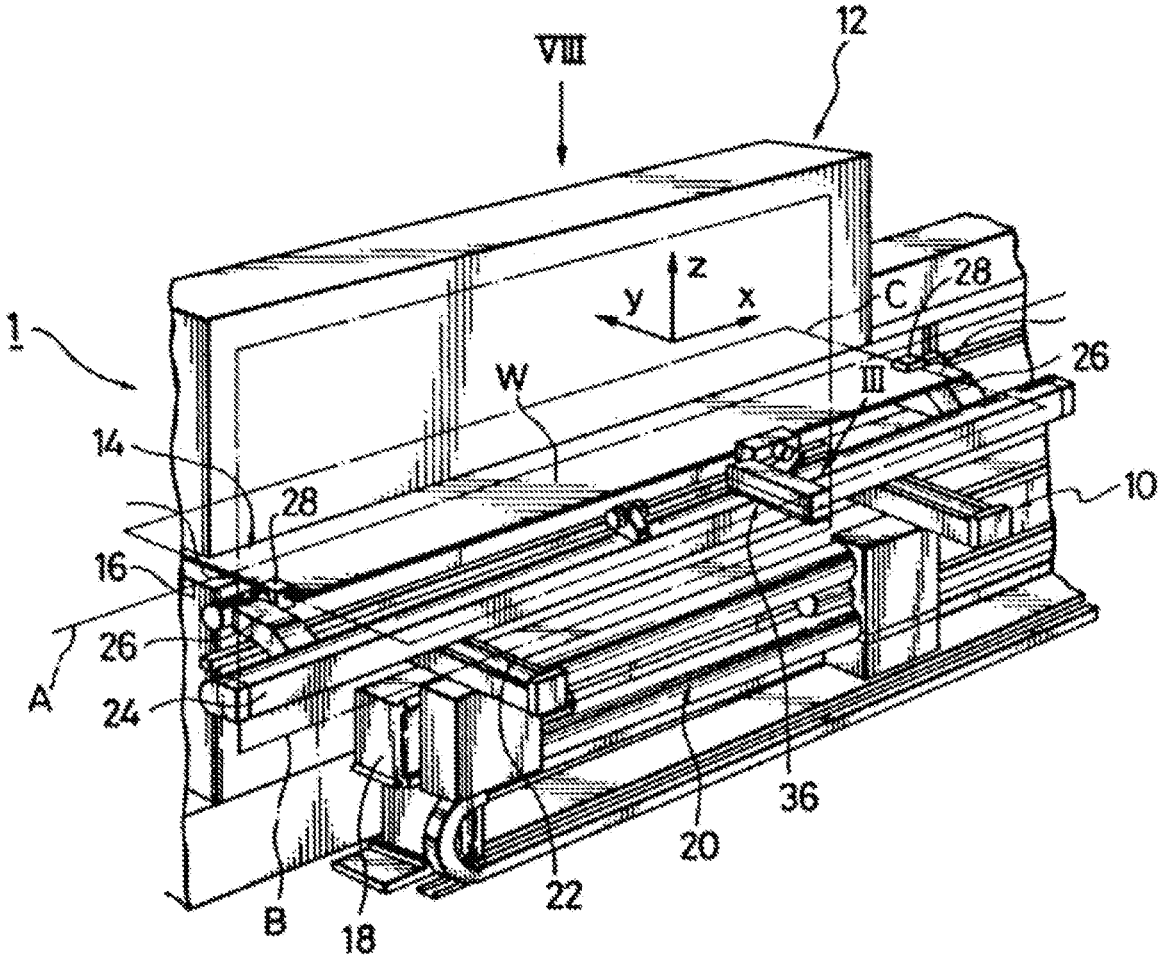
FIG. 2 (prior art)
FIG. 2 is a prior art illustration of a wood press system.
Figure 3:
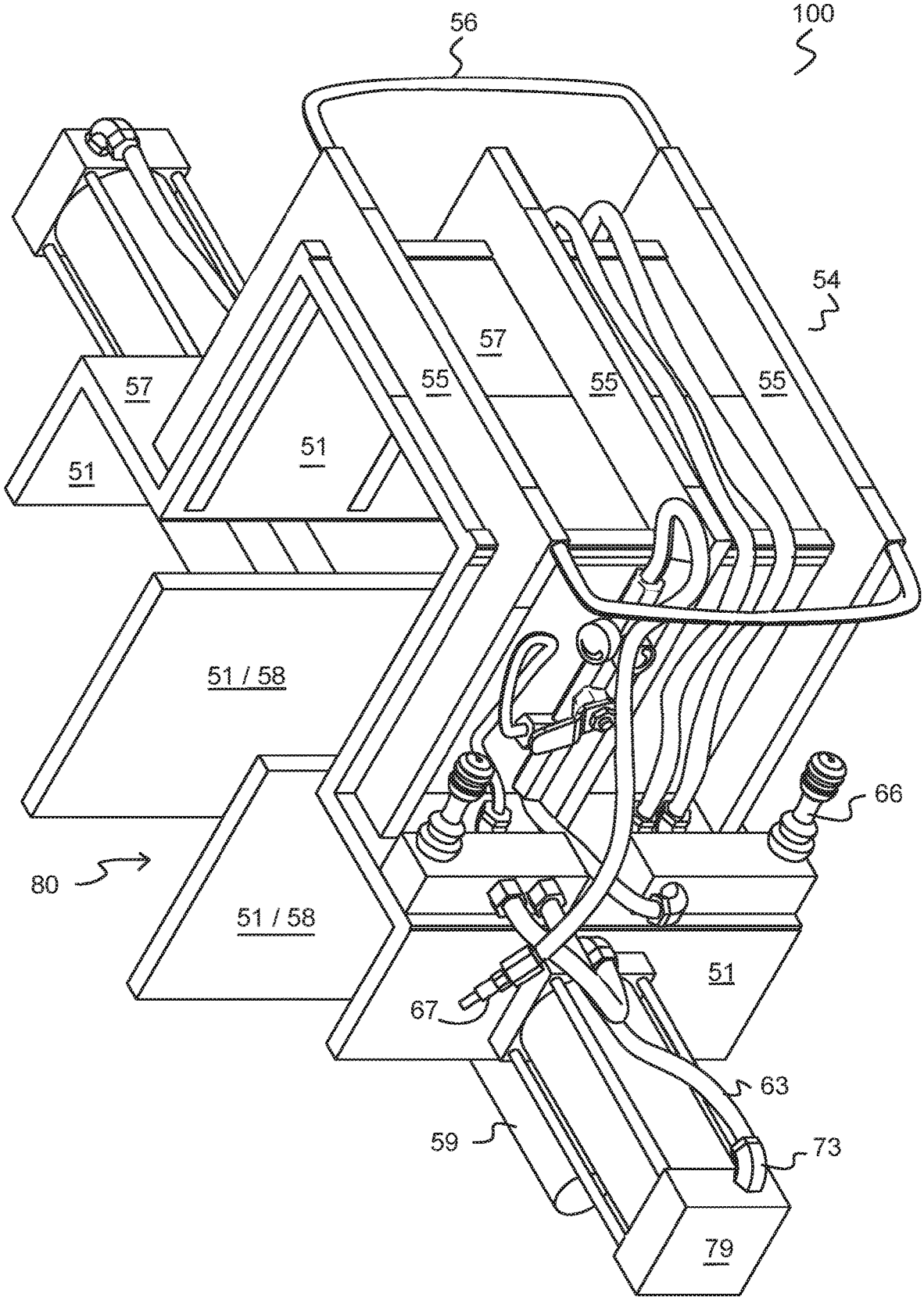
FIG. 3 is a top right perspective view of one embodiment of the lumber adjuster according to the present invention.
Figure 4:
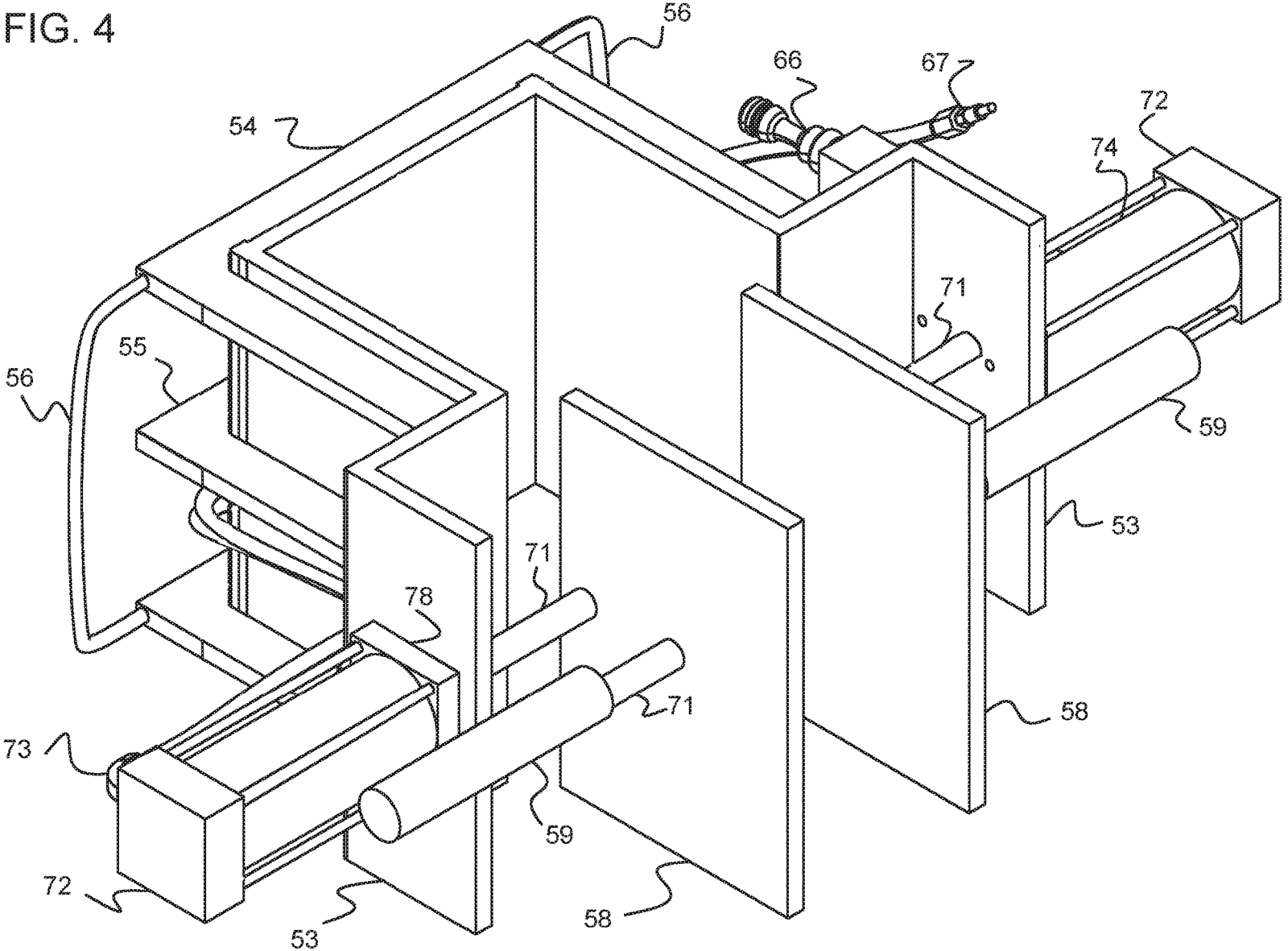
FIG. 4 is a bottom left perspective of the aligner of FIG. 3.

The present invention is illustrated in FIGS. 3-7 and features of the present invention will now be discussed with reference to these figures.

The wooden beam aligner according to the present invention 100 has a framework 50 having a main body 52 with vertical walls 51 and horizontal supporting panels 57. One of the horizontal supporting panels provides the base of the bridge 54 of the main body 52 which in turn has front, center, and rear vertical supporting ribs 55 providing increased structural support against buckling pressure. Left and right handles 56 extend from upper and outermost edges of the bridge 54 for carrying and mounting the aligner 100 into place for operation.

The base of two vertical walls 51 are integrally connected with two perpendicular L-shaped angle piston supports 53. Each of the angle supports 53 have vertical walls 51 and horizontal panels 57. The vertical walls 51 support the piston rod holders 59. In this embodiment, a first holder 59 is merely a channel through the vertical wall 51, and a second holder 59 is an integral hollow box. Both the first and second holders 59 engage in nearly frictionless sliding support of the piston rods 71.

The piston rods 71 then support the left and right pushing pads 58. These left and right pushing pads 58 are two vertical walls 51 which are otherwise disparate from the main body 52. The length 57L of the horizontal panels 57 of the angle supports 53 are less than the length 71 L of the piston rods 71.

Pneumatic System

Figure 5:
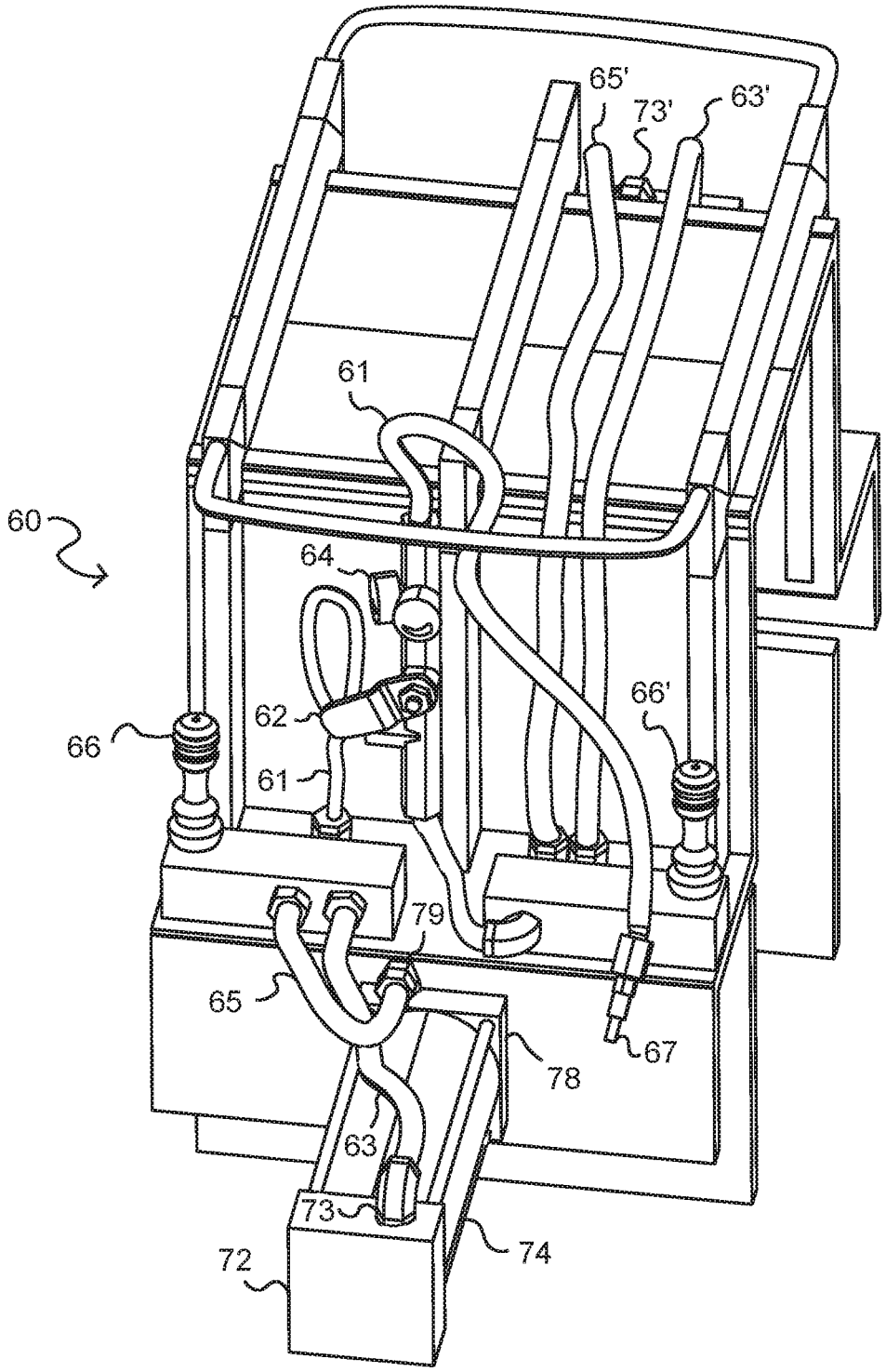
FIG. 5 is an alternative upper right perspective view of the aligner of FIG. 1 illustrating the pneumatic system.
Figure 6:
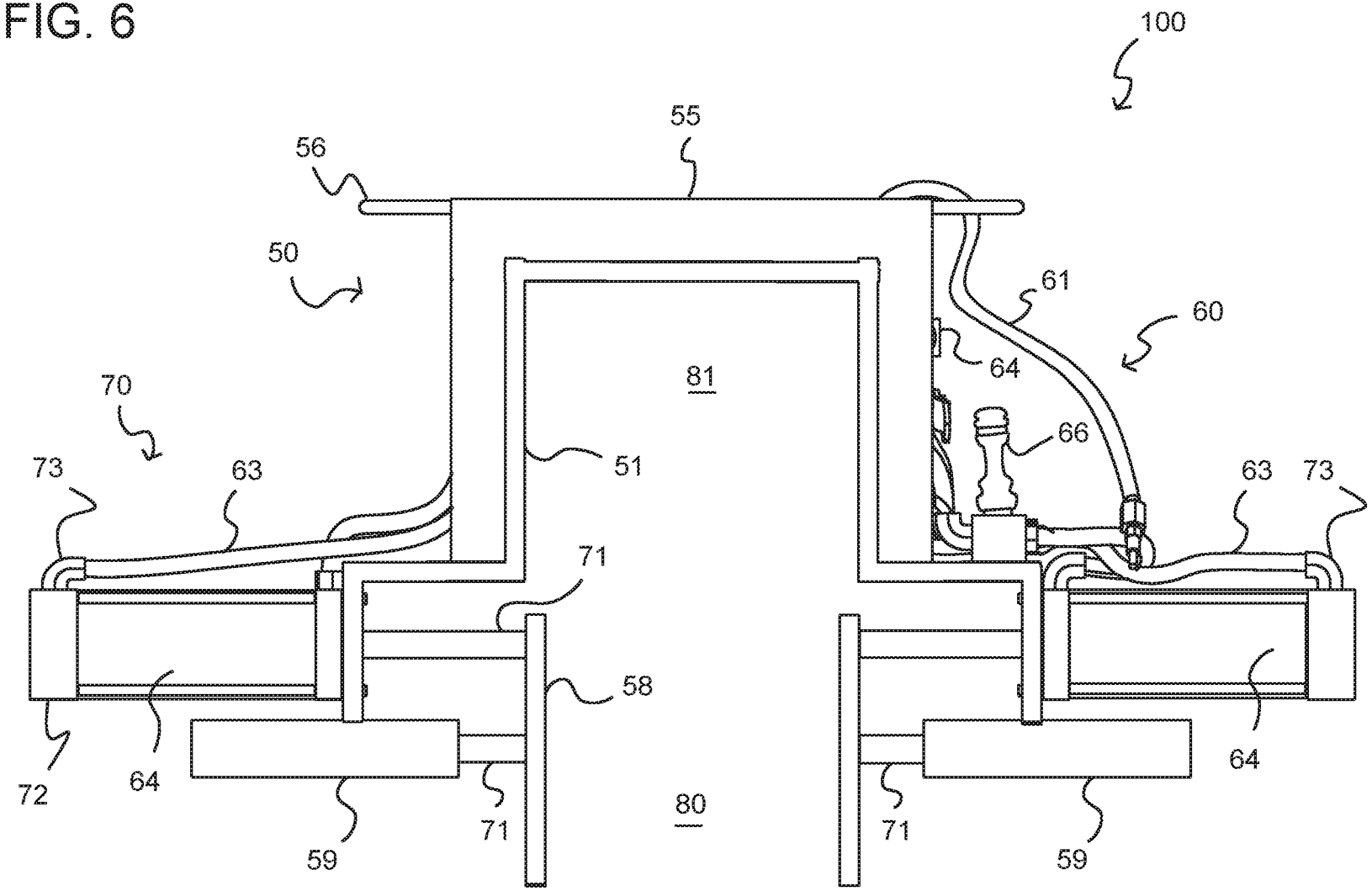
FIG. 6 is a front planar view of the aligner of FIG. 3.
Figure 7:
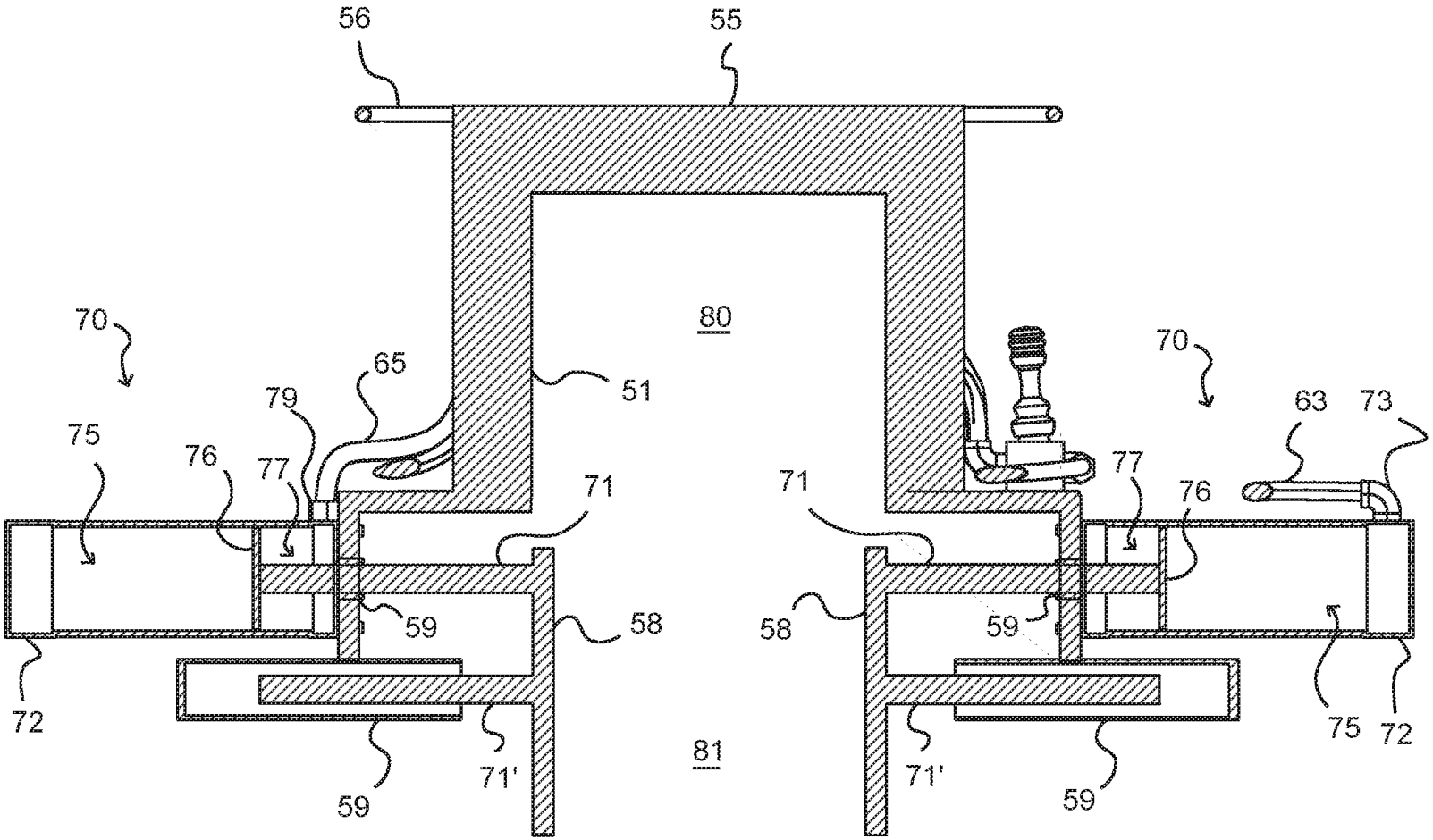
FIG. 7 is a front cross-sectional view of the aligner of FIG. 3.

The lumber adjuster 100 according to the present invention employs a modified pneumatic air pressure system 60 which will now be discussed in more detail with particular respect to FIGS. 5-7. The air flow pattern of the pneumatic system 60 is starts with being taken in by the nozzle 67 through tubing 61 to a first on/off switch 62, generally, a manual air flow valve, and more specifically a type of gate valve handle shut off valve 62. Next in line is an automatic emergency cut off pressure regulator 64 which can be manually adjusted in order to determine the pressure at which the regulator shuts off. The tubing 63 then directs the air flow to a directional switch 66, also a cylinder spool flow direction valve 66. This valve 66 can direct the air flow towards tubing input 63 connected to the airport rear end cap 72 of the pneumatic piston 70 or away from the airport rod end cap 79 via tubing output 65. The airport rear end cap 72 communicates with a first internal volume area 75 and the airport rod end cap 79 communicates with a second internal volume area 77 on opposing sides of the piston 76 in the cylinder barrel 74.

The piston 76 is fixedly connected to the piston rod 71, so the cylinder barrel 74 facilitates converting pneumatic energy to mechanical work. The piston is movable with reduced friction engagement within the cylinder barrel 74 to increase the ration of energy to work conversion. The dual nature of the cylinder barrel 74 ensures that pressurized air can work on both sides of the piston 76 to extend or retract the single-ended piston rod 71, and thus, the pushing pad 58.

The pneumatic piston 70 employed in one embodiment has a 50 mm bore and 100 mm stroke, double action and single rod, adjustable cushion on both cylinder end covers. The cylinder spool valve 66 has a detent hand lever for acting control, and the center is closed. There are five ports and four ways. The pressure port NPT, the port NPT and the exhaust NPT are all preferably between a half inch and a fifth inch. More preferably, the pressure port NPT and the port NPT are a quarter inch and the exhaust NPT is an eighth inch. The mounting type is a body, panel mount with a panel mount hold diameter of 22 mm with body material of aluminum alloy. The working pressure is preferably in a range of 10 to 200 PSI, and more preferably in a range of 21.76 to 116 PSI. An operating temperature is a range of −5 to 80° C.

A hand lever allows the user to simply and intuitively change the direction of flow. Tactile detents "click" to ensure the correct position has been reached. Intuitive design and a two-directional lever ensure simple interface. The valve 66 is panel mounted through three pre-drilled mounting holes in the valve's body.

Method of Operation

Figure 8:
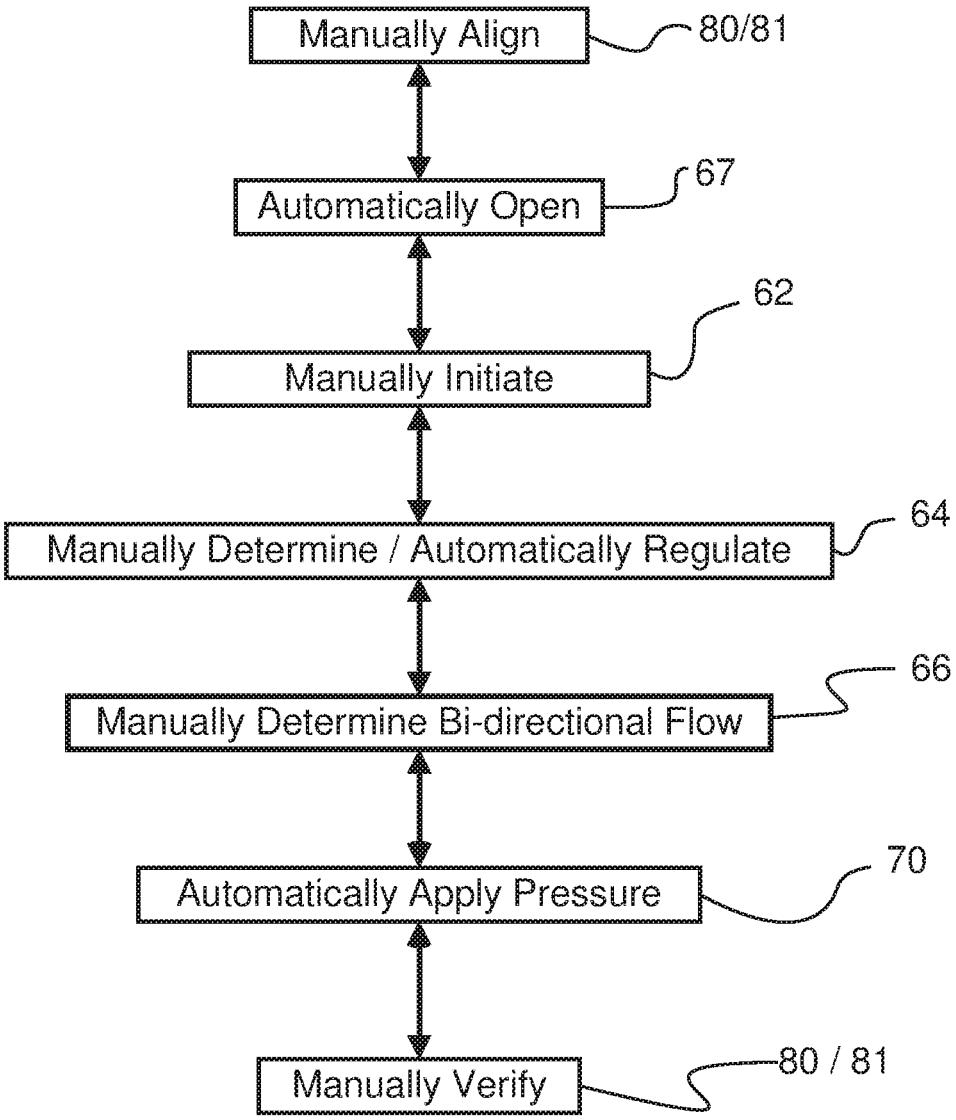
FIG. 8 is a diagrammatic illustration of a method of the present invention.
Figure 9:
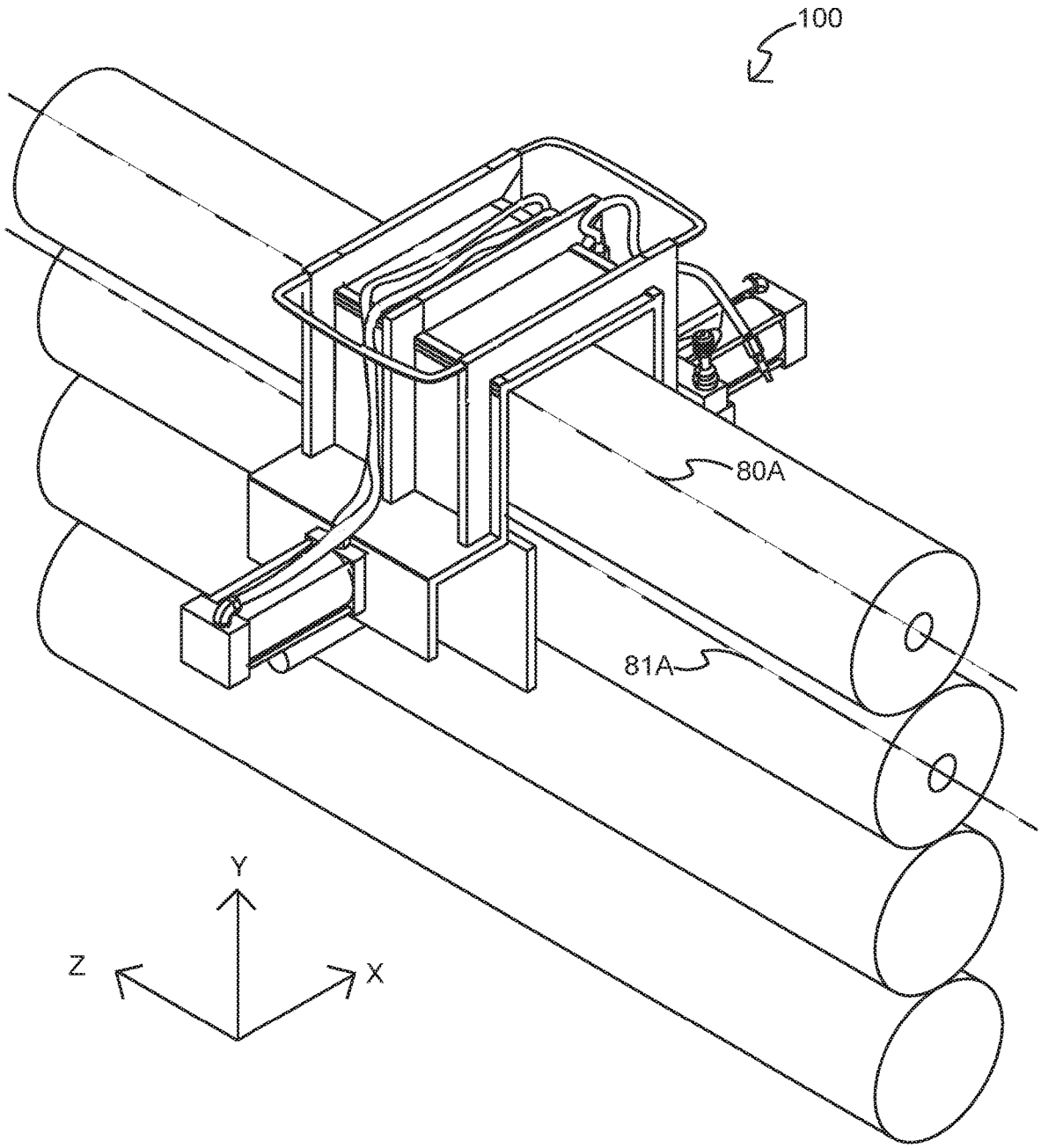
FIG. 9 is a front planar perspective illustration of the aligner of FIG. 3 while employed with respect to the wall of a log cabin.

The method of operation is discussed with reference to FIGS. 3-9, and more particularly to FIGS. 8-9. During use, the portable lumber adjuster 100 may be used to repair a bowed log while in the midst of building a log cabin without having to dismantle any previous work. Because of this, it is not necessary to disassemble any partially built wall, remove the bowed wood, ship to the repairing facility, and wait to finish the wall until the wall component can be returned to the building site. Instead, during use, the portable aligner 100 may be lifted by handles 56 and arranged over the log wall so that the bent log fits within the channel 80 under the bridge 54.

The channels 80, 81 have axis 80A, 80A which are manually aligned with the axis of the logs of the wall to be straightened, that is, coaxial with the corresponding log axis. Before operation, the automatic emergency cut off pressure regulator 64 is manually adjusted in order to determine the pressure at which the regulator shuts off. The amount of action necessary is determined and the directional switch 66 is manually set. The nozzle 67 is automatically opened, and the on/off switch 62 manually initiates the system. Upon start up, the pressure system 60 provides pressure to the piston system which automatically applies pressure to the push pads, until the first channel axis 80A and the second channel axis 81A are vertically aligned with one another. The walls 51 and pushing pads 58 maintain their position, holding the bent beam in vertical alignment with the remainder of the wall while the position of the bent log is secured via conventional means with respect to the remainder of the log cabin wall.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

REFERENCE NUMBERS

The following reference numbers have been employed to refer to their respective elements in the present specification and accompanying figures.

General

X directional horizontal axis
Y directional vertical axis
Z directional transverse axis
B working plane
C loading plane perpendicular to the working plane
L Length
H Height
W Width Prior Art:

1 straightening machine
2 upper mold
2' single upper molds
3 lower mold
4' depression monomers
6 shorter edges
7 hydraulic pump
10 a press brake system with a device
12 press brake
14 upper die (a punch)
16 lower die (a matrix)
18 support and guide beam
20 carriage
22 transverse guides
24 cross member
26 two arms
28 gripper heads Present Invention:

100 beam straightener/lumber adjuster
50 Framework
51 Walls—Vertical panels, left, right
52 Main Body
53 Angle piston support left, right
54 Bridge
55 Wall supports ribs on bridge: front, center, rear
56 Handles left and right
57 Base supports—horizontal panels, middle, top
58 Pushing pad, left, right
59 Rod holder, left, right
60 Pneumatic Air Pressure System
61 Tubing
62 On/Off manual switch—Air Flow Valve—gate valve handle—shut off valve
64 Automatic Emergency cut off—Pressure regulator 64
66 Directional switch—Cylinder Spool Valve—flow direction valve 66
63 Tubing input (towards airport rear cap) 63
65 Tubing output (away from airport rod cap) 65
70 Pneumatic system
71 piston rod
72 Rear end cap
73 Airport rear cap
74 Cylinder barrel
75 Internal volume area before piston
76 Piston
77 Internal volume area after piston
78 Rod End Cap
79 Airport rod end cap
80 First channel
80A Axis of first channel
81 Second channel
81A Axis of second channel

What is claimed is:

1. A portable lumber adjuster capable of adjusting wooden beams while building a log cabin, the portable lumber adjuster comprising:

a framework having a framework handle, and the framework having a horizontal panel and two vertical walls, the horizontal panel and the two vertical walls forming a bridge having a channel;

a pressure system having at least an initiation switch, a pressure regulator, and a manually adjustable valve; and a piston system fluidly connected to the pressure system and securely supported by the framework, the piston system having a piston rod connected to a push pad;

wherein the push pad is capable of vertical alignment with at least one of the two vertical walls of the framework: and wherein the portable lumber adjuster has a size and weight so as to be capable of being lifted by the framework handle manually for carrying and mounting the portable lumber adjuster into place for operation.

2. The portable lumber adjuster of claim 1 wherein the bridge of the framework further comprising three supporting ribs of steel at least 2 mm thick.

3. The portable lumber adjuster of claim 1 wherein the framework handle is a right handle, and the framework further comprises a left handle, wherein the right and left handle extend outwards from the bridge for carrying and mounting the portable lumber adjuster into place for operation.

4. The portable lumber adjuster of claim 1 wherein a base of a first of the two vertical walls of the framework is integrally and perpendicularly connected with a horizontal piston supporting wall; the first horizontal piston supporting wall being integrally and perpendicularly connected with a vertical piston supporting wall; the vertical piston supporting wall being integrally connected with a rod holder; and the rod holder slidingly engaging the piston rod.

5. The portable lumber adjuster of claim 1 wherein the pressure system is a pneumatic pressure system, and the piston system is a pneumatic piston system; the pneumatic pressure system having tubing connecting the initiation switch, the pressure regulator, and the manually adjustable valve to a pneumatic piston of the pneumatic piston system.

6. The portable lumber adjuster of claim 5 wherein:

the initiation switch is a manual air flow initiation switch;

the pressure regulator is an automatic emergency cut off pressure regulator;

the manually adjustable valve is a manually adjustable cylinder spool bi-directional flow valve;

the manually adjustable cylinder spool bi-directional flow valve being capable of directing air flow in either a first air flow path towards an airport rear end cap and away from an airport rod end cap, or a second air flow path away from the airport rear end cap and towards the airport rod end cap; and the first air flow path causing the pneumatic pistons to move in a first direction, and the second air flow path causing the pneumatic pistons to move in a second direction opposite to the first direction.

7. The portable lumber adjuster of claim 5 wherein the pneumatic piston having a 50 mm bore, 100 mm stroke, and an adjustable cushion on both cylinder end covers.

8. The portable lumber adjuster of claim 6 wherein the manually adjustable cylinder spool bi-directional flow valve has a working pressure in a range of 10 to 200 PSI.

9. A method of adjusting wooden beams while building a log cabin comprising the steps of:

recognizing a first log as horizontally misaligned with respect to a second log being vertically adjacent the first log;

manually lifting a portable lumber adjuster by a handle;

positioning the adjuster such that an axis of the first log is coaxial with a first channel of the adjuster, and an axis of the second log is coaxial with a second channel of the adjuster;

determining a direction of misalignment of the first log with respect to the second log;

setting a direction for a push pad of the adjuster;

initiating a pressure system capable of moving the push pad of the adjuster; and horizontally adjusting the axis of the first log so as to be vertically aligned with the axis of the second log.

10. A portable lumber adjuster for adjusting a first axis of a first log with respect to a second axis of a second log, the portable lumber adjuster comprising:

a framework having a horizontal panel and two vertical walls, the horizontal panel and the two vertical walls forming a bridge having a first channel, the first channel being sized to accommodate a first diameter of the first log; and a pressure system and a piston system fluidly connected to the pressure system, the pressure system and the piston system being securely and solely supported by the framework, the piston system having a pair of piston rods, each of the pair of piston rods being connected to one of a pair of push pads, respectively;

wherein the pair of push pads forming a second channel, the second channel being sized to accommodate a second diameter of the second log;

wherein the pair of piston rods facilitate movement of the pair of push pads, such that the second channel of the pair of push pads is vertically aligned with first channel of the bridge; and wherein the portable lumber adjuster has a size and weight so as to be capable of being lifted manually by the framework handle for carrying and mounting the portable lumber adjuster into place for operation.

* * * * *